US009837722B2

(12) United States Patent
Minard et al.

(10) Patent No.: US 9,837,722 B2
(45) Date of Patent: Dec. 5, 2017

(54) DIPOLE ANTENNA WITH INTEGRATED BALUN

(71) Applicant: THOMSON LICENSING, Issy les Moulineaux (FR)

(72) Inventors: Philippe Minard, Saint Medard sur Ille (FR); Claude Rambault, St. Sulpice la Foret (FR); Dominique Lo Hine Tong, Rennes (FR); Anthony Aubin, Bourgbarre (FR)

(73) Assignee: THOMSON Licensing, Issy-les-Moulineaux ( * ) Notice: Subject to any disclaimer, the term of this patent is extended or adjusted under 35 U.S.C. 154(b) by 0 days.

(21) Appl. No.: 15/178,516

(22) Filed: Jun. 9, 2016

(65) Prior Publication Data

US 2016/0365640 A1 Dec. 15, 2016

(30) Foreign Application Priority Data

Jun. 9, 2015 (EP) ..... 15305874

(51) Int. Cl.
*H01Q 1/24* (2006.01)
*H01Q 9/28* (2006.01)
(Continued)

(52) U.S. Cl.
CPC ..... *H01Q 9/285* (2013.01); *H01Q 1/2291* (2013.01); *H01Q 1/36* (2013.01); *H01Q 1/38* (2013.01);
(Continued)

(58) Field of Classification Search
CPC ..... H01Q 9/285; H01Q 1/36; H01Q 1/38; H01Q 1/48; H01Q 1/50; H01Q 1/2291;
(Continued)

(56) References Cited

U.S. PATENT DOCUMENTS 3,364,491 A 1/1968 Stohr
3,623,112 A * 11/1971 Rupp ..... H01Q 3/26 333/238
(Continued)

FOREIGN PATENT DOCUMENTS

EP 2009737 12/2008
WO WO2004062028 7/2004

OTHER PUBLICATIONS

Kwon et al., "Suppression of Cable Leakage Current for Edge-Fed Printed Dipole UWB Antennas Using Leakage-Blocking Slots", IEEE Antennas and Wireless Propagation Letters, vol. 5, 2006, pp. 183-186.
(Continued)

*Primary Examiner* — Tho G Phan
(74) *Attorney, Agent, or Firm* — Brian J. Dorini; Patricia A. Verlangieri

(57) ABSTRACT

The invention relates to a dipole antenna including first and second radiating elements electrically connected via a transition, said first and second elements being associated with a frequency $f_1$ in a frequency band, a feeding point the feeding point and the reference point being respectively connected to a feeding conductor and a ground conductor of a feeding line, and a balun. The balun is formed by a slot arranged in the first radiating element, said slot having a short circuit at a first end and an open circuit at a second end next to the transition. The feeding point and the reference point are arranged on opposite sides of the slot.

15 Claims, 6 Drawing Sheets

(51) Int. Cl.

| | |
|---|---|
| ***H01Q 1/22*** | (2006.01) |
| ***H01Q 1/38*** | (2006.01) |
| ***H01Q 9/24*** | (2006.01) |
| ***H01Q 5/371*** | (2015.01) |
| ***H01Q 1/36*** | (2006.01) |
| ***H01Q 1/48*** | (2006.01) |
| ***H01Q 1/50*** | (2006.01) |

(52) U.S. Cl.
CPC ..... *H01Q 1/48* (2013.01); *H01Q 1/50* (2013.01); *H01Q 5/371* (2015.01); *H01Q 9/24* (2013.01)

(58) Field of Classification Search
CPC ..... H01Q 5/371; H01Q 5/47; H01Q 9/16; H01Q 9/24
See application file for complete search history.

(56) References Cited

U.S. PATENT DOCUMENTS

| | | | | |
|---|---|---|---|---|
| 3,845,490 | A * | 10/1974 | Manwarren | H01P 5/1007 333/238 |
| 5,519,408 | A * | 5/1996 | Schnetzer | H01Q 13/085 343/767 |
| 5,532,708 | A | 7/1996 | Krenz et al. | |
| 6,043,785 | A * | 3/2000 | Marino | H01Q 1/246 343/700 MS |
| 6,246,377 | B1 * | 6/2001 | Aiello | H01Q 1/36 343/767 |
| 7,724,201 | B2 | 5/2010 | Nysen et al. | |
| 2004/0140941 | A1 | 7/2004 | Joy et al. | |
| 2014/0132469 | A1 | 5/2014 | Wang et al. | |
| 2014/0210680 | A1 | 7/2014 | Stoytchev | |
| 2017/0062919 | A1 * | 3/2017 | Ross, III | H01Q 1/36 |

OTHER PUBLICATIONS

Glisson, A., "Book Review of Modern Antenna Design", IEEE Antennas and Propagation Society Newsletter, Feb. 1986, pp. 12-13.

Stoytchev et al., "Compact Antenna Arrays for MIMO Applications", IEEE International Symposium on Antennas and Propagation, Boston, Massachusetts, USA, Jul. 8, 2001, pp. 708-711.

Suh et al., "Wireless performance improvement using an embedded balanced dipole antenna in laptop computer considering platform noise impact", IEEE International Symposium on Antennas and Propagation Symposium, San Diego, California, USA, Jul. 5, 2008, pp. 1-4.

* cited by examiner

DIPOLE ANTENNA WITH INTEGRATED BALUN

This application claims the benefit, under 35 U.S.C. §119 of European Patent Application No. 15305874.8, filed Jun. 9, 2015.

1. TECHNICAL FIELD

The present invention relates to a new antenna design for application in wireless systems that are more generally, but not limited to, integrated in home-networking electronic devices, such as set-top-boxes, gateways and smart home devices.

The invention is related more particularly to an antenna comprising a balun function.

2. BACKGROUND ART

With the advent of the wireless technology, lots of products such as set-top-boxes, gateways and smart home devices comprise embedded antennas. The embedded antennas are generally integrated within the product all around a printed circuit board (PCB) supporting at least the wireless chipset. The chipset is connected to the antennas via antenna cables of different lengths.

The integration of these antennas could impair the wireless system performances if they are not properly designed, by picking up noise from different sources of the wireless product such as for example, in a set-top-box, from high speed and/or high power buses (PCi-e, RGMII, Sata, USB, HDMI, . . . ), from a digital chip (CPU), from feeding lines of a SDRAM memory, etc. . . . This noise can couple to the antenna either through the radiating element or through the shielding of the antenna cable due to the common mode currents. These leakages of electric current can happen when the feeding of the dipole antenna is unbalanced.

FIG. 1 shows a schematic view of a dipole antenna fed with a coaxial cable and illustrates the common mode current issue. This dipole is composed of two radiating elements, the first radiating element being connected to the central feeding conductor of the coaxial cable and the second radiating element being connected to the shielding of the coaxial cable. The electric current that comes from the central feeding conductor of the coaxial cable is denoted $I_A$. The electric current that comes from the inner side of the shielding of the coaxial cable is denoted $I_B$ where $I_B=-I_A$. However, outside of the coaxial cable, this current $I_B$ is spread between the second radiating element of the dipole ($I_B-I_C$) and the outer side of the coaxial cable ($I_C$). The current flowing on the outer side of the coaxial cable, called common mode current $I_C$, can radiate and couple to external noise sources, which must be avoided in modern wireless systems. Moreover, this unwanted current leakage all along the coaxial cable creates several additional radiating sources that are combined to the radiation of the radiating element. That leads to an increase of the antenna directivity and cross-polarization, and a modification of the radiation pattern shape. Both impacts affect MIMO system performance since in this case the transceiver output power must be reduced in order to comply with regulation specification and the angular coverage is low.

Different solutions have been developed to reduce this parasitic coupling and/or reduce the common mode current $I_C$.

One solution consists in increasing the antenna cable length to find a new cable routing avoiding the coupling with the different noise sources. The major drawback of this solution is that it increases the cable losses and thus provides, with an additional cost, lower antenna efficiency.

Another solution consists in using a balun (contraction of "balanced to unbalanced transformer") that converts unbalanced signals into balanced signals. The balun is inserted between the cable and the antenna. Several baluns can be used, such as for example folded balun, sleeve balun, split coax balun, half wavelength balun or candelabra balun. This balun may be a ceramic balun and/or use ferrite beads or RF chokes/inductors to prevent the common mode currents returning back down on the outer of the cable. This solution adds extra-cost to the antenna and can modify the radiation pattern shape and/or increase the directivity with interaction between the antenna and the additional devices. The balun can also be integrated to the dipole antenna and realized in a printing technology. In that case, the balun is inserted between the radiating elements of the dipole, which increases the size of the antenna.

3. SUMMARY OF INVENTION

One purpose of the invention is to propose a dipole antenna equipped with a balun and having a reduced global size.

A first aspect of the invention relates to a dipole antenna comprising:

- at least a first radiating element and a second radiating element electrically connected via a transition,
- a feeding point on the first radiating element and a reference point, the feeding point being connected to a feeding conductor of a feeding line and the reference point being connected to a ground conductor of said feeding line, and
- a balun, wherein the balun comprises at least a first slot arranged within the first radiating element, said first slot having a short circuit at a first end and an open circuit at a second end next to the transition, and

- the feeding point and the reference point are arranged on opposite sides along the first slot. The balun may be arranged within the first radiating element such that it is surrounded on at least three sides by the first radiating element According to the embodiments of the invention, the balun is integrated into one of the two radiating elements of the dipole antenna. Such an arrangement contributes to obtaining a more compact antenna.

In a particular embodiment, the reference point is arranged on the side of the slot comprising the transition.

In a first embodiment, the length of the first slot is substantially equal to $\lambda_1/4$, where $\lambda_1$ is a guided wavelength the first frequency $f_1$ associated with said first and second radiating elements.

In this embodiment, the feeding point and the reference point are advantageously arranged on opposite sides of the first slot next to the transition.

In a variant, the length of the first slot may be different from $\lambda_1/4$ and the reference point is advantageously arranged next to the transition in order to optimize the impedance matching of the antenna in the bandwidth.

According to the embodiments of the invention, the feeding line belongs to the following group:

- a coaxial cable,
- a microstrip or strip line,
- a coplanar waveguide line,
- a slot line.

In a particular embodiment, the general shape of the first and second radiating elements is ellipsoidal or rectangular or triangular or trapezoidal or polygonal.

In a particular embodiment, the balun further comprises at least one second slot, said at least one second slot opening in the first slot.

In a particular embodiment, the length of said at least one second slot is substantially equal to the length of the first slot in order to reinforce the balun function at the frequency $f_1$.

In a particular embodiment, the dipole antenna further comprises a third radiating element connected to the first radiating element and a fourth radiating element electrically connected to the second radiating element, said third and fourth radiating elements being associated with a second frequency $f_2$ in a second frequency band of the antenna.

In a particular embodiment, the first frequency band is the frequency band [5.15 GHz, 5.85 GHz] and the frequency $f_1$ is one frequency within the frequency band [5.15 GHz, 5.85 GHz].

In a particular embodiment, the second frequency band is the frequency band [2.4 GHz, 2.5 GHz] and the frequency $f_2$ is one frequency within the frequency band [2.4 GHz, 2.5 GHz].

In a particular embodiment, the dipole comprises a single or multilayer substrate wherein the first and second radiating elements and, if applicable, the third and fourth radiating elements are arranged on said single or multilayer substrate.

In a variant, the dipole antenna is realized in a stamped metal technology.

A further aspect of the invention relates to an electronic wireless device comprising at least one dipole antenna according to any embodiment of the first aspect of the invention. In a particular embodiment, the electronic wireless comprises a gateway device or a set top box device.

4. BRIEF DESCRIPTION OF THE DRAWINGS

The invention can be better understood with reference to the following description and drawings, given by way of example and not limiting the scope of protection, and in which.

5. DESCRIPTION OF EMBODIMENTS

Figure 1:
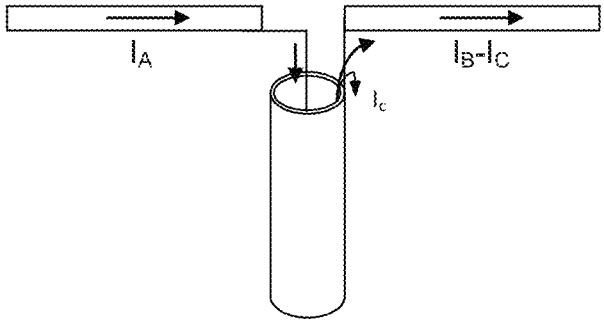
FIG.1 (prior art)
FIG. 1 is a schematic view illustrating the currents flowing through a dipole antenna connected to a coaxial line.

While example embodiments are capable of various modifications and alternative forms, embodiments thereof are shown by way of example in the drawings and will herein be described in details. It should be understood, however, that there is no intent to limit example embodiments to the particular forms disclosed, but on the contrary, example embodiments are to cover all modifications, equivalents, and alternatives falling within the scope of the claims. Like numbers refer to like elements throughout the description of the figures.

The invention will be hereinafter described through two embodiments, one single band antenna and one dual band antenna. Of course, the invention can be applied to multiband antennas.

FIGS. 2 to 9 a single band dipole antenna according to a first embodiment of the invention.

Figure 2:
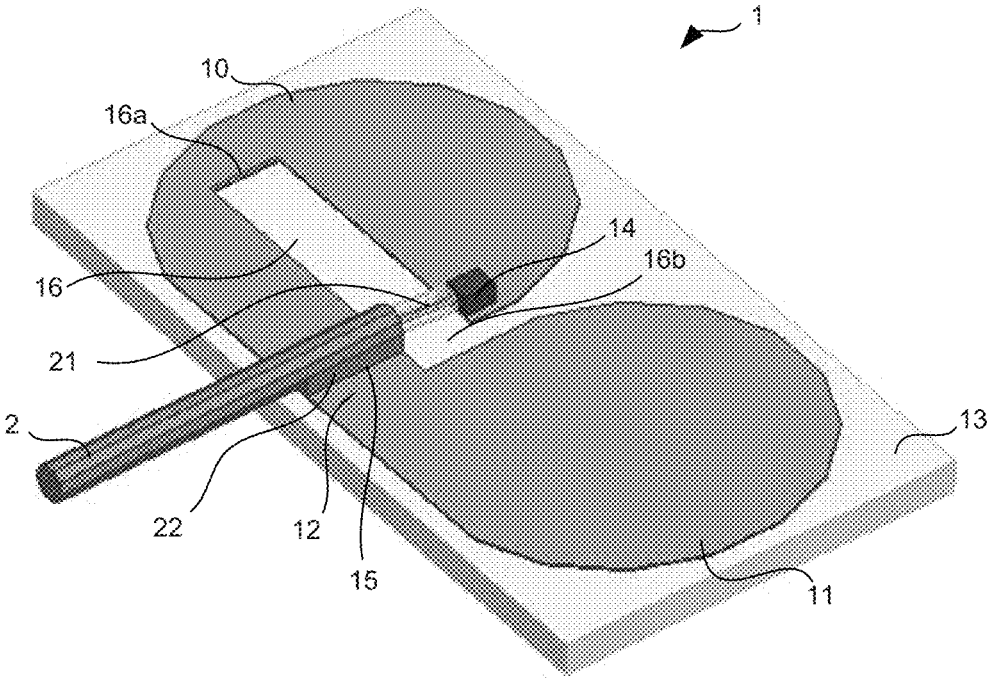
FIG. 2 is a perspective view of the dipole antenna according to a first embodiment of the invention.

FIG. 2 is perspective view of the single band antenna. In reference to this figure, the dipole antenna 1 comprises two radiating elements 10 and 11 electrically connected together via a transition 12. In this embodiment, the dipole antenna is realized on a dielectric substrate 13. The radiating elements 10 and 11 are etched in a conductive layer deposited on the substrate. The transition 12 designates the area of the conductive layer connecting electrically the radiating element 10 to the radiating element 11. In this embodiment, the general shape of the two radiating elements is ellipsoidal. Of course, other radiating element shapes can be used. For example, other radiator elements with triangular, trapezoidal or polygonal or rectangular shapes can be used. Such a radiating element design with large width relatively to the length contributes to obtain a compact antenna.

The total length of the radiating elements is advantageously around half of the guided wavelength of a given frequency $f_1$ in a desired frequency band, for a frequency in the WiFi band [5.15 GHz-5.85 GHz].

The dipole antenna 1 is fed with a feeding line 2 comprising a feeding conductor 21 and a ground conductor 22. In the FIG. 2, the feeding line is a coaxial line. The shielding of the coaxial line is the ground conductor. Other feeding lines may be used, such as a microstrip or strip line, or a coplanar waveguide (CPW) line or a slot line.

The feeding conductor 21 of the feeding line is connected to the radiating element 10 at a feeding point 14 and the ground conductor 22 is connected to the antenna at a reference point 15.

The dipole antenna 1 further comprises a balun in order to prevent common mode currents returning back down on the outer of the feeding line 2.

According to embodiments of the invention, the balun comprises a slot 16 arranged in the radiating element 10. The slot 16 of rectangular shape has a short circuit at a first end 16*a* and an open circuit at a second end 16*b* next to the transition 12. The feeding point 14 and the reference point 15 are arranged on opposite sides of the slot 16. The opposite sides extend along the slot from the first end 16*a* to the second end 16*b*.

The reference point 15 is arranged on the side of the slot comprising the transition 12. It is positioned at the transition 12 or close to the transition. Advantageously, the length of the slot 16 is substantially equal to $\lambda_1/4$, where $\lambda_1$ is a guided wavelength of the frequency $f_1$. But this length can be modified in order to optimize the impedance matching in the frequency band.

Similarly, the feeding line is preferably centered between the two radiating elements of the antenna but it can be shifted in order to optimize the impedance matching in the frequency band.

Other slot shapes, like a meander slot or a tapered slot, may be used in order to achieve the requested frequency bandwidth.

Similarly, one or several holes may be inserted in the radiators in order to improve its radiated performances.

The performances of such an antenna configuration have been evaluated for achieving an omnidirectional WiFi antenna in the 5 GHz band.

Figure 3:
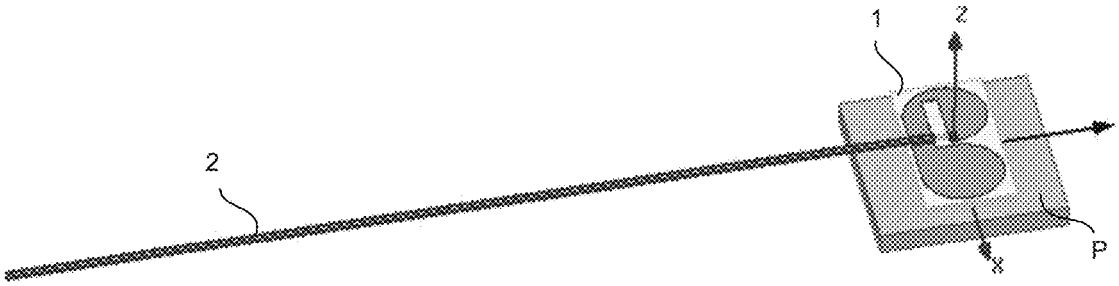
FIG. 3 shows a dipole antenna as depicted in FIG. 2 working in the WiFi band 5 GHz.

FIG. 3 shows the tested antenna attached to a piece P of plastic part (ABS). The antenna 1 is stuck to the plastic part by an adhesive/foam tape on a side wall of a cabinet designed to maintain the antenna in a desired position. This antenna design has been simulated using the HFSSTM 3D electromagnetic simulation tool. Some relevant dimensions are given here below:

- substrate dimensions: 17.5 mm×9.8 mm;
- thickness of the antenna metal part: 0.03 mm;
- total length (in the x direction) of the radiating elements: 16.5 mm;
- length of the slot 16: 6 mm up to the transition;
- length of the coaxial cable 2: 100 mm (only 10 mm are modeled as a coaxial cable, the other 90 mm only the shielding is considered);
- plastic material: ABS;
- plastic part dimensions: 20 mm×20 mm×2.5 mm;
- Gap between the bottom of the substrate and the plastic part P: 1 mm corresponding to the width of the foam tape.

The performances of such an antenna are illustrated by the FIGS. 4 to 8.

Figure 4:
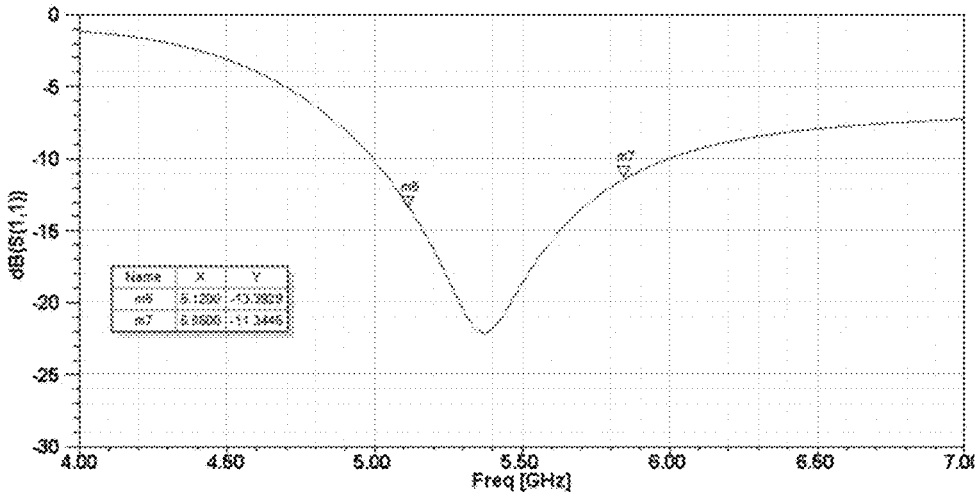
FIG. 4 shows a curve illustrating the return loss response of the antenna of FIG. 3 versus frequency.

FIG. 4 is a curve illustrating the return loss (S(1,1) in dB) of the antenna versus frequency. This figure shows that a wide matching band (return loss<−10 dB) is achieved for the band 5 GHz-6 GHz, covering the desired WiFi band [5.15 GHz-5.85 GHz].

Figure 5:
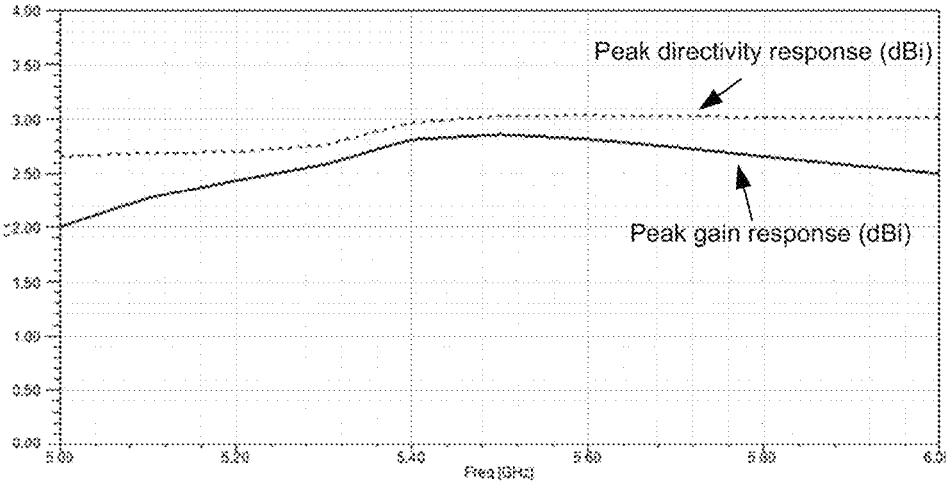
FIG. 5 shows two curves illustrating the peak gain response and the peak directivity response of the antenna of FIG. 3 versus frequency.

FIG. 5 shows two curves illustrating the peak gain response and the peak directivity response of the antenna of FIG. 3 versus frequency. This figure shows a fair level (~3 dBi) of directivity is achieved (the antenna is considered as being omnidirectional), demonstrating a low effect of the coaxial cable on the radiated performances of the antenna. Similarly, the simulated gains are quite at the same levels around 2.5/2.8 dBi on the whole frequency band.

Figure 6:
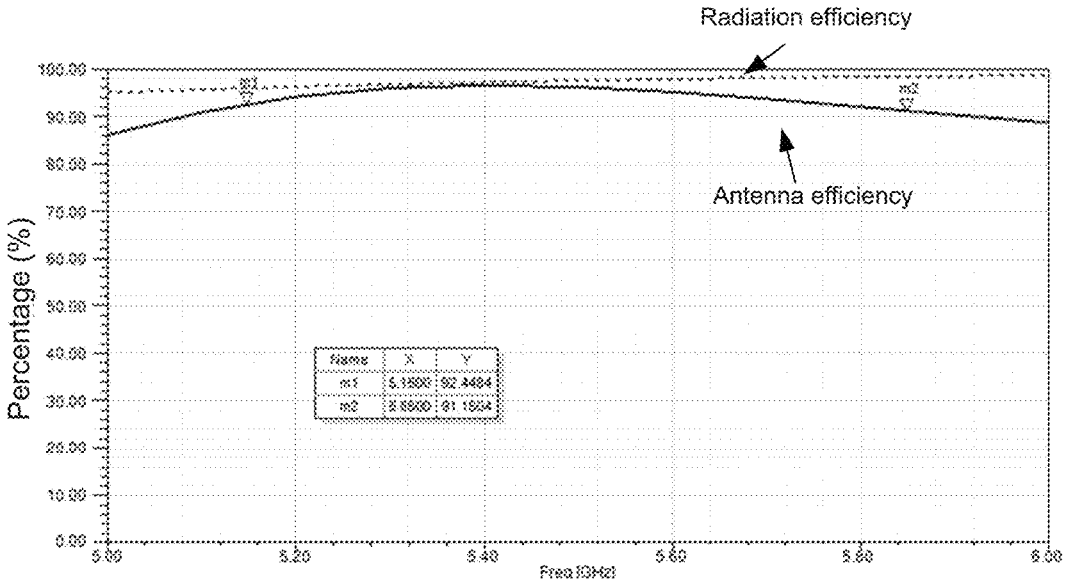
FIG. 6 shows two curves illustrating the antenna efficiency response and the radiation efficiency response of the antenna of FIG. 3 versus frequency.

FIG. 6 shows two curves illustrating the antenna and the radiation efficiencies (in percentage) in the band [5 GHz-6 GHz]. These two curves show high radiation efficiency and high antenna efficiency (close to 90%) in the whole band.

Figure 7:
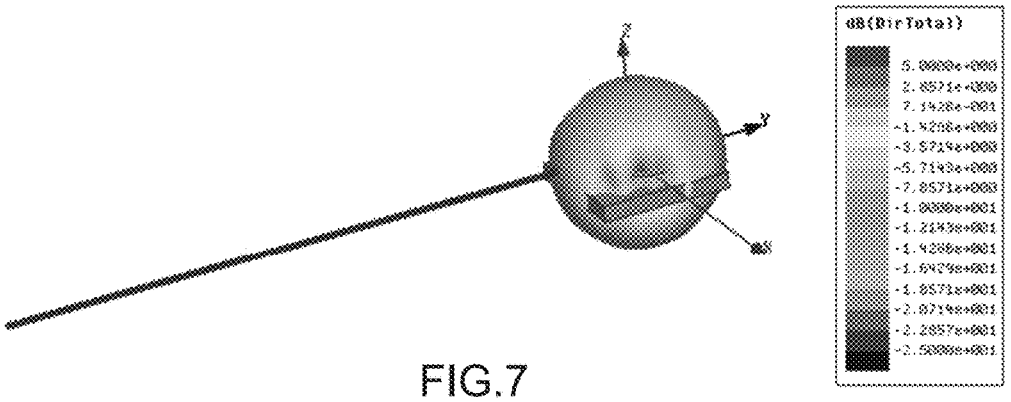
FIG. 7 shows the 3D directivity radiation pattern of the antenna of FIG. 3 at 5.5 GHz.

FIG. 7 illustrates the 3D directivity radiation pattern (in dBi) of the antenna at 5.5 GHz. This figure shows very low ripples.

Figure 8:
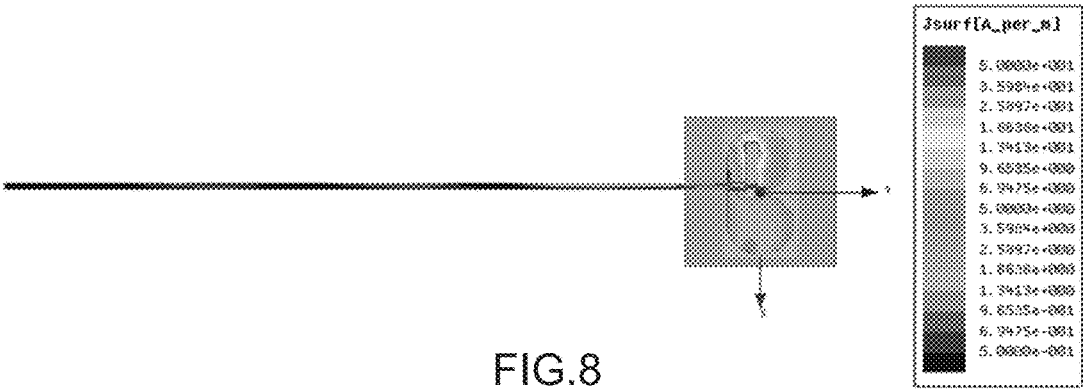
FIG. 8 shows the electric current density distribution of the antenna of FIG. 3 at 5.5 GHz.

FIG. 8 depicts the electric current density distribution (in A/m) of the antenna at 5.5 GHz. This figure shows that the highest current level is located at the short circuit plane of the slot and that the lowest current level is located near the reference point. It allows minimizing the current (common mode current) returning back down in the outer surface of the coaxial line 2.

All these simulation measurements show that the balun integrated in the radiating element 10 fulfills the desired function, i.e. preventing common mode current returning back down in the outer surface of the coaxial line without degrading the gain and radiation performances of the antenna. This integration of the balun in one radiating element of the antenna allows achieving a low-cost compact antenna.

The antenna illustrated by FIG. 2 to FIG. 8 comprises a single slot 16, integrated in the radiating element 10.

Figure 9:
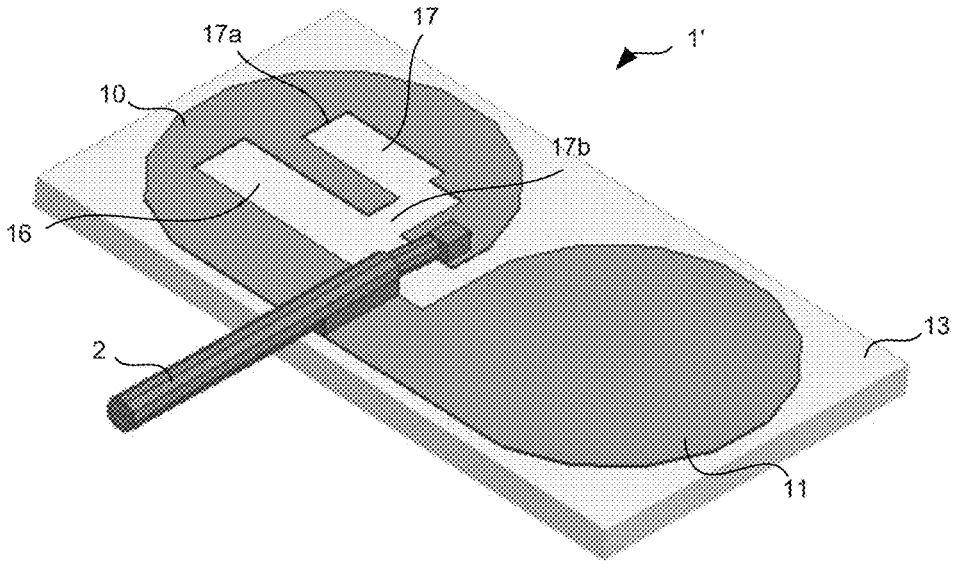
FIG. 9 is a perspective view of the dipole antenna according to a second embodiment of the invention.

In a variant illustrated by FIG. 9, the antenna, referenced 1', comprises an additional slot, 17, in the radiating element 10, the slot 17 opening in the slot 16. The slot 17 has a L shape. This slot comprises a short circuit at a first end 17*a* and an open circuit at a second end 17*b* next to the end 16*b* of the slot 16.

The length of the slot 17 is advantageously substantially equal to the length ($\lambda_1/4$) of the slot 16 in order to reinforce the balun function at the frequency $f_1$.

In another variant, the reference point 15 is present arranged on the side of the slot opposite to the side comprising the transition 12. In that case, the performances of the antenna are lower.

The antenna previously described in reference to the FIGS. 2 to 9 is adapted to radiate or receive signals of a given frequency band. The invention can also be applied to multiband antennas.

Figure 10:
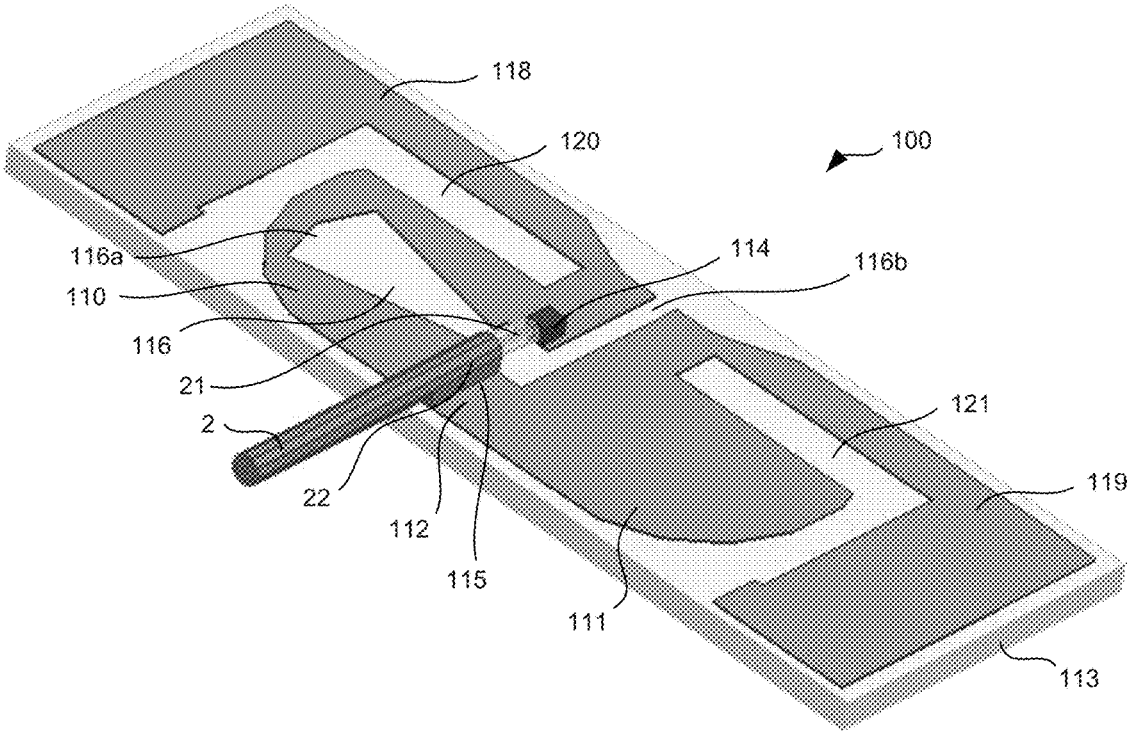
FIG. 10 is a perspective view of the dipole antenna according to a third embodiment of the invention working in the two frequency bands.

FIG. 10 shows a perspective view of a dual band antenna 100 according to an embodiment of the invention.

In reference to this figure, the dipole antenna 100 comprises two radiating elements 110 and 111 electrically connected together via a transition 112. These two radiating elements are associated with a first frequency band, for example the WiFi band [5.15 GHz-5.85 GHz]. The radiating elements 110 and 111 are etched in a conductive layer deposited on a dielectric substrate 113. The total length of the radiating elements 110 and 111 is advantageously around half of the guided wavelength of a given frequency $f_1$ in a first frequency band, for example a frequency in the WiFi band [5.15 GHz-5.85 GHz].

The dipole also comprises two radiating elements 118 and 119 electrically connected to the radiating elements 110 and 111 respectively. The radiating elements 118 and 119 are associated with a frequency $f_2$ in a second frequency band, for example a frequency in the WiFi band [2.4 GHz-2.5 GHz]. In the FIG. 10, the radiating elements 118 and 119 are L-shaped arms in order to obtain a compact antenna. The radiating element 118 is separated from the radiating element 110 by a L-shaped slot 120 and the radiating element 119 is separated from the radiating element 111 by a L-shaped slot 121. The total length of the radiating elements 118 and 119 is advantageously around half of the guided wavelength of a given frequency $f_2$ in a second frequency band, for example a frequency in the WiFi band [2.4 GHz-2.5 GHz].

Like in FIG. 2, the dipole antenna 100 is fed with a feeding line 2 comprising a feeding conductor 21 and a ground conductor 22. The feeding line is a coaxial line.

The feeding conductor 21 of the feeding line is connected to the radiating element 110 at a feeding point 114 and the ground conductor 22 is connected to the antenna at a reference point 115.

According to embodiments of the invention, the dipole antenna 100 comprises a balun in order to prevent common mode currents returning back down on the outer of the feeding line 2. The balun comprises a slot 116 arranged in the radiating element 110. The slot 116 has a tapered shape and comprises a short circuit at a first end 116*a* and an open circuit at a second end 116*b* next to the transition 112. The feeding point 114 and the reference point 115 are arranged along the slot 116, on opposite sides of the slot. The reference point 115 is present at the transition or close to the transition 112.

Advantageously, the length of the slot 16 is substantially equal to $\lambda_1/4$, where $\lambda_1$ is a guided wavelength of the frequency $f_1$.

The performances of such an antenna configuration have been evaluated for achieving an omnidirectional WiFi antenna in both the 2.4 GHz band and the 5 GHz band.

Figure 11:
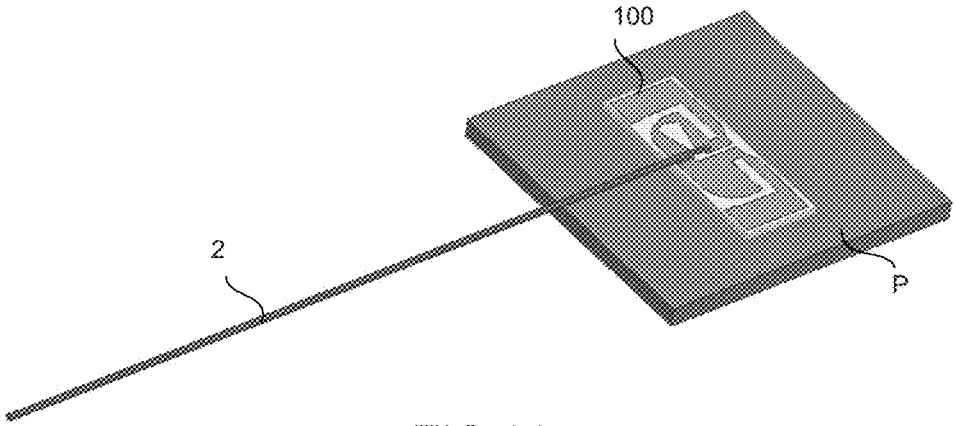
FIG. 11 shows a dipole antenna as depicted in FIG. 10 working in the two WiFi bands 2.4 GHz and 5 GHz.

FIG. 11 shows the tested antenna attached to a piece P of plastic part (ABS). The antenna 100 is stuck to the plastic part by an adhesive/foam tape on a side wall of a cabinet designed to maintain the antenna in a desired position. This antenna design has been simulated using the HFSSTM 3D electromagnetic simulation tool. Some relevant dimensions are given here below:

substrate dimensions: 26 mm×9.8 mm;
thickness of the antenna metal part: 0.03 mm;
total length (in the x direction) of the radiating elements: 42.6 mm @ 2.45 GHz and 16.5 mm @ 5.5 GHz;
length of the slot 116: 6 mm up to the transition;
length of the coaxial cable 2: 100 mm (only 10 mm are modeled as a coaxial cable, the other 90 mm only the shielding is considered);
plastic material: ABS;
plastic part dimensions: 40 mm×40 mm×2.5 mm;
adhesive tape between the bottom of the substrate and the plastic part P: 0.1 mm.

The performances of such an antenna are illustrated by the FIGS. 12 to 16.

Figure 12:
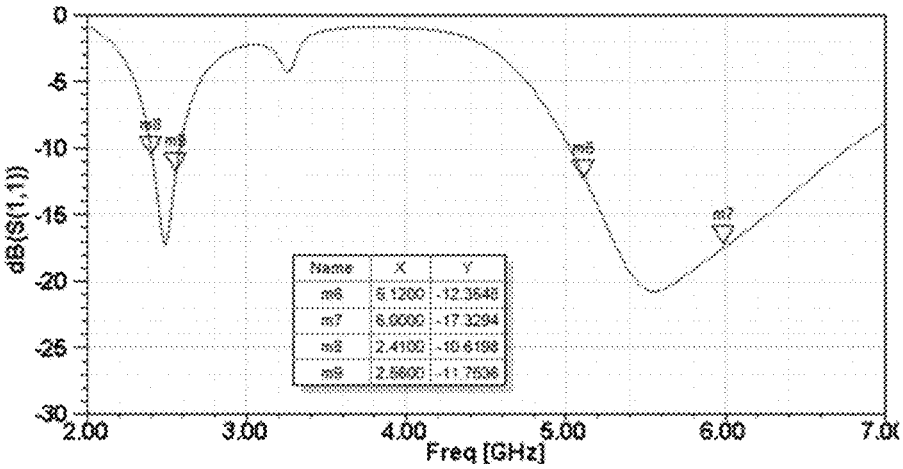
FIG. 12 shows a curve illustrating the return loss response of the antenna of FIG. 11 versus frequency.

FIG. 12 is a curve illustrating the return loss (S(1,1)) (in dB) of the antenna versus frequency. This figure shows that a wide matching band (return loss<−10 dB) is achieved for the WiFi bands 5 GHz and 2.4 GHz.

Figure 13:
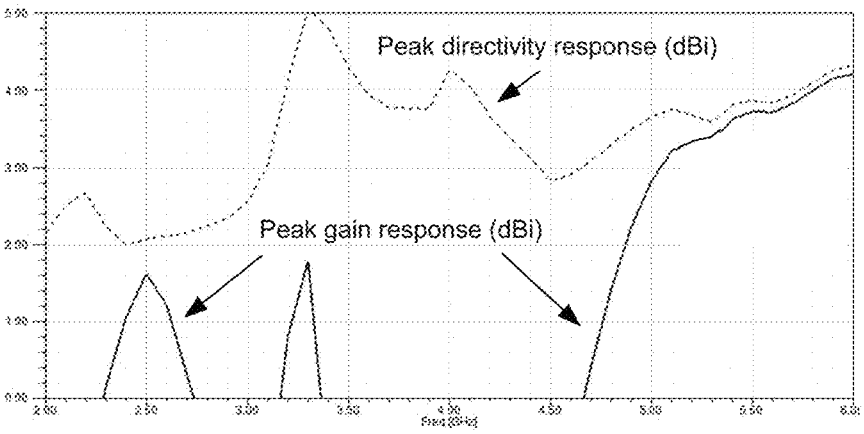
FIG. 13 shows two curves illustrating the peak gain response and the peak directivity response of the antenna of FIG. 11 versus frequency.

FIG. 13 shows two curves illustrating the peak gain response (in dBi) and the peak directivity response of the antenna of FIG. 3 versus frequency. This figure shows a fair level (~2 dBi in the 2.4 GHz band and 3.6 to 4.2 dBi in the 5 GHz band) of directivity is achieved (the antenna is considered as being omnidirectional), demonstrating a low effect of the coaxial cable on the radiated performances of the antenna. Similarly, the simulated gains are quite at the same levels around 1/1.5 dBi in the 2.4 GHz band and 3/3.5 dBi in the 5 GHz band.

Figure 14:
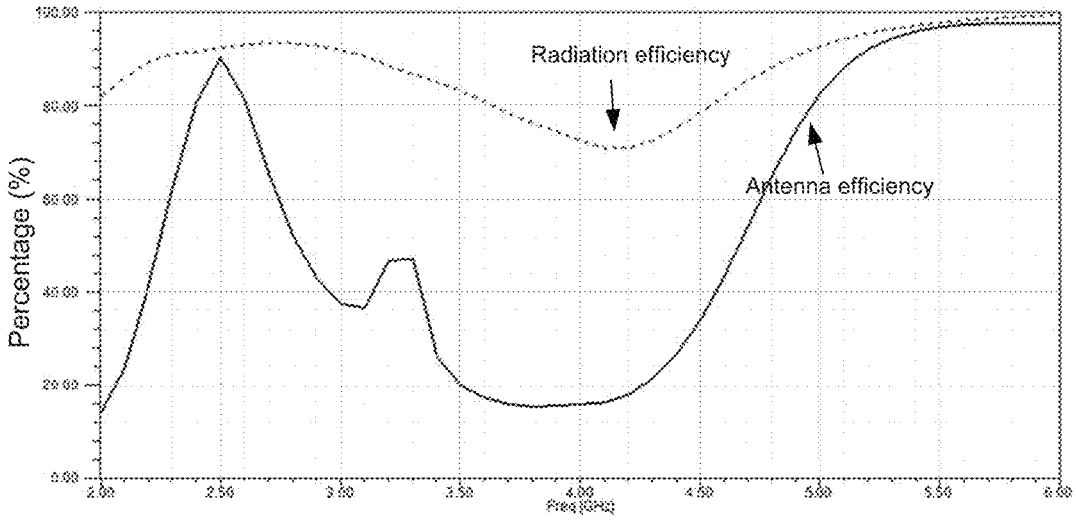
FIG. 14 shows two curves illustrating the antenna efficiency response and the radiation efficiency response of the antenna of FIG. 11 versus frequency.

FIG. 14 shows two curves illustrating the antenna and the radiation efficiencies (in percentage) in the two WiFi bands at 2.4 GHz and 5 GHz. These two curves show high radiation efficiency and high antenna efficiency (close to 90%) in the two bands.

Figure 15:
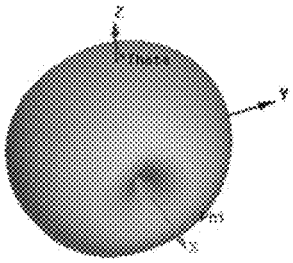
FIG. 15 shows the 3D directivity radiation pattern of the antenna of FIG. 11 at 2.45 GHz.
Figure 16:
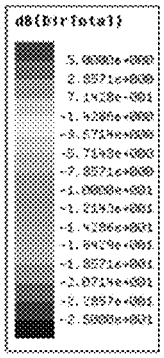
FIG. 16 shows the 3D directivity radiation pattern of the antenna of FIG. 11 at 5.5 GHz.
Figure 16:
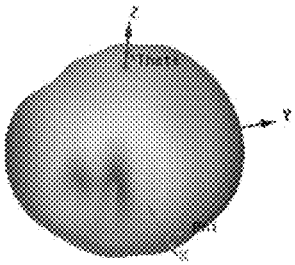

FIG. 15 illustrates the 3D directivity radiation pattern (in dBi) of the antenna at 2.45 and FIG. 16 illustrates the 3D directivity radiation pattern of the antenna at 5.5 GHz. These two figures show very low ripples.

The dipole antenna with an integrated balun as disclosed hereinabove allows more compact antennas to be obtained, allowing a better integration level within the electronic products. The integration of the balun in one of the two radiating elements demonstrates a lower interaction with the coaxial cable than with the state of the art dipole feeding (with or without balun).

The proposed antenna according to embodiments of the invention can be realized either in printed technology on a single or several conductive layers, or in stamped metal technology. These two technologies are well adapted to the mass market.

Although some embodiments of the present invention have been illustrated in the accompanying drawings and described in the foregoing detailed description, it should be understood that the present invention is not limited to the disclosed embodiments, but is capable of numerous rearrangements, modifications and substitutions without departing from the invention as set forth and defined by the following claims.

The invention claimed is:

1. A dipole antenna comprising:

at least a first radiating element and a second radiating element electrically connected via a transition, a feeding point on the first radiating element and a reference point, the feeding point being connected to a feeding conductor of a feeding line and the reference point being connected to a ground conductor of said feeding line, and a balun, wherein the balun comprises at least a first slot arranged within the first radiating element, said first slot having a short circuit at a first end and an open circuit at a second end next to the transition, and the feeding point and the reference point are arranged on opposite sides of said first slot.

2. The dipole antenna according to claim 1, wherein the reference point is arranged on the side of the slot comprising the transition.

3. The dipole antenna according to claim 1, wherein the length of the first slot is substantially equal to $\lambda_1/4$, where $\lambda_1$ is a guided wavelength of a first frequency $f_1$ associated with the first and second radiating elements.

4. The dipole antenna according to claim 3, wherein the reference point is present at the transition.

5. The dipole antenna according to claim 3, wherein the first frequency band is the frequency band [5.15 GHz, 5.85 GHz] and the frequency $f_1$ is one frequency within the frequency band [5.15 GHz, 5.85 GHz].

6. The dipole antenna according to claim 1, wherein the feeding line belongs to the following group:

a coaxial cable,
a microstrip or strip line,
a coplanar waveguide line,
a slot line.

7. The dipole antenna according to claim 1, wherein the general shape of the first and second radiating elements is ellipsoidal or rectangular or triangular or trapezoidal or polygonal.

8. The dipole antenna according to claim 1, wherein the balun further comprises at least one second slot, said at least one second slot opening in the first slot.

9. The dipole antenna according to claim 8, wherein the length of said at least one second slot is substantially equal to the length of the first slot.

10. The dipole antenna according to claim 1, further comprising a third radiating element electrically connected to the first radiating element and a fourth radiating element electrically connected to the second radiating element, said third and fourth radiating elements being associated with a second frequency $f_2$ in a second frequency band of the antenna.

11. The dipole antenna according to claim 10, wherein the second frequency band is the frequency band [2.4 GHz, 2.5 GHz] and the frequency $f_2$ is one frequency within the frequency band [2.4 GHz, 2.5 GHz].

12. The dipole antenna according to claim 1, comprising a single or multilayer substrate (13,113) wherein the first and second radiating elements and, if applicable, the third and fourth radiating elements are arranged on said substrate.

13. The dipole antenna according to claim 1, wherein the dipole antenna is realized in a stamped metal technology.

14. An electronic wireless device comprising at least one dipole antenna according to claim 1.

15. An electronic wireless device according to claim 14 comprising a gateway device or a set top box device.

* * * * *